US007326106B1

(12) United States Patent
Rogers et al.

(10) Patent No.: US 7,326,106 B1
(45) Date of Patent: Feb. 5, 2008

(54) DEVICE FOR TREATING FLOORING SURFACES

(75) Inventors: McCurdy Rogers, Knoxville, TN (US); Matthew Frank Humphreys, Maryville, TN (US)

(73) Assignee: Vic International Corporation, Powell, TN (US)

( * ) Notice: Subject to any disclaimer, the term of this patent is extended or adjusted under 35 U.S.C. 154(b) by 39 days.

(21) Appl. No.: 11/293,877

(22) Filed: Dec. 2, 2005

(51) Int. Cl.
*B24B 23/00* (2006.01)

(52) U.S. Cl. ..... 451/350; 451/353; 15/49.1

(58) Field of Classification Search ..... 451/350, 451/353, 357; 15/49.1
See application file for complete search history.

(56) References Cited

U.S. PATENT DOCUMENTS

| | | | | |
|---|---|---|---|---|
| 835,631 | A | 11/1906 | Mooney et al. | |
| 1,877,031 | A | 9/1932 | Olson | |
| 1,919,389 | A | 7/1933 | Myers | |
| 1,928,390 | A | 9/1933 | Myers | |
| 2,671,915 | A | 3/1954 | Fraser et al. | |
| 2,710,416 | A | 6/1955 | Lalonde | |
| 3,398,490 | A | 8/1968 | Redifer | |
| 4,387,538 | A | 6/1983 | Tetsuro | |
| 4,731,956 | A | 3/1988 | Wood | |
| 4,742,652 | A * | 5/1988 | Cannan et al. | 451/353 |
| 5,070,656 | A | 12/1991 | Brogden | |
| 5,377,375 | A | 1/1995 | Holman et al. | |
| 5,439,413 | A | 8/1995 | Lägler | |
| 5,637,032 | A | 6/1997 | Thysell et al. | |
| 5,674,120 | A | 10/1997 | Legatt et al. | |
| 6,238,277 | B1 | 5/2001 | Duncan et al. | |
| 6,331,138 | B1 | 12/2001 | Witters et al. | |
| 6,425,813 | B1 | 7/2002 | Ernst | |
| 6,494,772 | B1 | 12/2002 | Barnes et al. | |
| 6,494,773 | B1 * | 12/2002 | Marchini et al. | 451/353 |
| 6,540,596 | B1 * | 4/2003 | Van Der Veen | 451/350 |
| 6,783,447 | B2 | 8/2004 | Van Vliet et al. | |
| 7,155,768 | B2 * | 1/2007 | Morita et al. | 15/98 |
| 2003/0114901 | A1 | 6/2003 | Immordino, Jr. et al. | |
| 2004/0023608 | A1 * | 2/2004 | Van Vliet et al. | 451/350 |
| 2006/0026781 | A1 * | 2/2006 | Van Vliet | 15/49.1 |
| 2006/0207393 | A1 * | 9/2006 | Stupar | 81/177.75 |

FOREIGN PATENT DOCUMENTS

| | | |
|---|---|---|
| SU | 745652 | 7/1980 |

* cited by examiner

*Primary Examiner*—Eileen P. Morgan
(74) *Attorney, Agent, or Firm*—Luedeka, Neely & Graham, PC

(57) ABSTRACT

Apparatus for treating flooring surfaces, the apparatus includes a drum assembly which provides counter-rotation of the drum assembly relative to the direction of rotation of the surfacing discs to provide improved handling characteristics. The apparatus also includes a frame with leg structures that pivot relative to the frame and of adjustable height to facilitate maintenance tasks, such as replacement of surfacing disks. A handle structure is also included that can be configured in a variety of positions and adapted to assist with maintenance tasks such as motor removal.

10 Claims, 9 Drawing Sheets

DEVICE FOR TREATING FLOORING SURFACES

FIELD OF THE INVENTION

This invention relates generally to surfacing equipment. More particularly, this invention relates to equipment for treating floor surfaces such as concrete floor surfaces including removing coatings, grinding, polishing, and other surface preparation.

BACKGROUND AND SUMMARY OF THE INVENTION

Ground and polished concrete flooring is becoming very popular. Such flooring is typically prepared by treating such as by grinding and polishing a concrete floor surface by use of a grinding machine equipped with abrasive surfacing discs. Improvement is desired in the construction of such treating machines.

This disclosure relates to a device for treating floor surfaces, such as grinding and polishing concrete floors. In one aspect, counter-rotation of a drum assembly portion of the device relative to the direction of rotation of surfacing discs of the device is enabled to provide improved handling characteristics as well as a higher quality finish having reduced swirl patterns and the like. In this regard, and in accordance with a preferred embodiment, the device includes a motor having a rotatable drive shaft; and a drum assembly driven by the drive shaft.

The drum assembly includes a first assembly having a first support with a plurality of rotatable treating shafts rotatably located thereon and operably connected to the drive shaft by a first belt so that rotation of the drive shaft results in rotation of each of the treating shafts in a first direction. Each of the treating shafts has a surfacing disc operatively connected to a first end thereof for rotation in the first direction for treating of a flooring surface.

The drum assembly also include a second assembly having a second support fixedly connected to the first support and configured to receive a second end of a selected one of the rotatable treating shafts opposite the surfacing disc associated therewith, a sheave fixedly connected to the second support, and a second belt which extends around the sheave and the second end of the selected rotatable treating shaft.

During operation of the apparatus, rotation of the drive shaft drives the first belt which results in rotation of the rotatable treating shafts including the selected treating shaft. The rotation of the selected treating shaft is transferred to the sheave by the second belt so as to cause the first and second supports to rotate in a second direction opposite the first direction. This advantageously provides a counter-rotation action of the drum assembly relative to the surfacing discs which improves handling and control as well as the quality of the finish achieved.

In another aspect, the device is configured to enable the drum assembly to be pivoted to facilitate maintenance tasks such as replacement of the surfacing discs. In a preferred embodiment, the device includes a treating assembly and a movable frame for pivotally supporting the treating assembly. The frame includes a fixed support member pivotally supporting the treating assembly, a pivoting support member pivotally connected to the fixed support member, and a leg assembly connected to the pivoting support member and having an adjustable length.

The length of the leg may be extended and the pivoting support member pivoted away from the fixed support member to enable the treating assembly to be pivoted for facilitating maintenance tasks such as replacement of treating discs.

In yet another aspect, the device is configured to facilitate maintenance tasks such as motor removal. In a preferred embodiment, the device includes a treating assembly, a frame supporting the treating assembly, a handle movably connected to the frame between a first position and a second position, and a wench connectable to the handle.

The handle may be positioned in the first position for treating flooring surfaces and in the second position to substantially overlie the treating assembly, When the handle is positioned in the second position the wench may be connected to the handle at a location to enable the wench to be utilized to remove a portion of the treating assembly.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
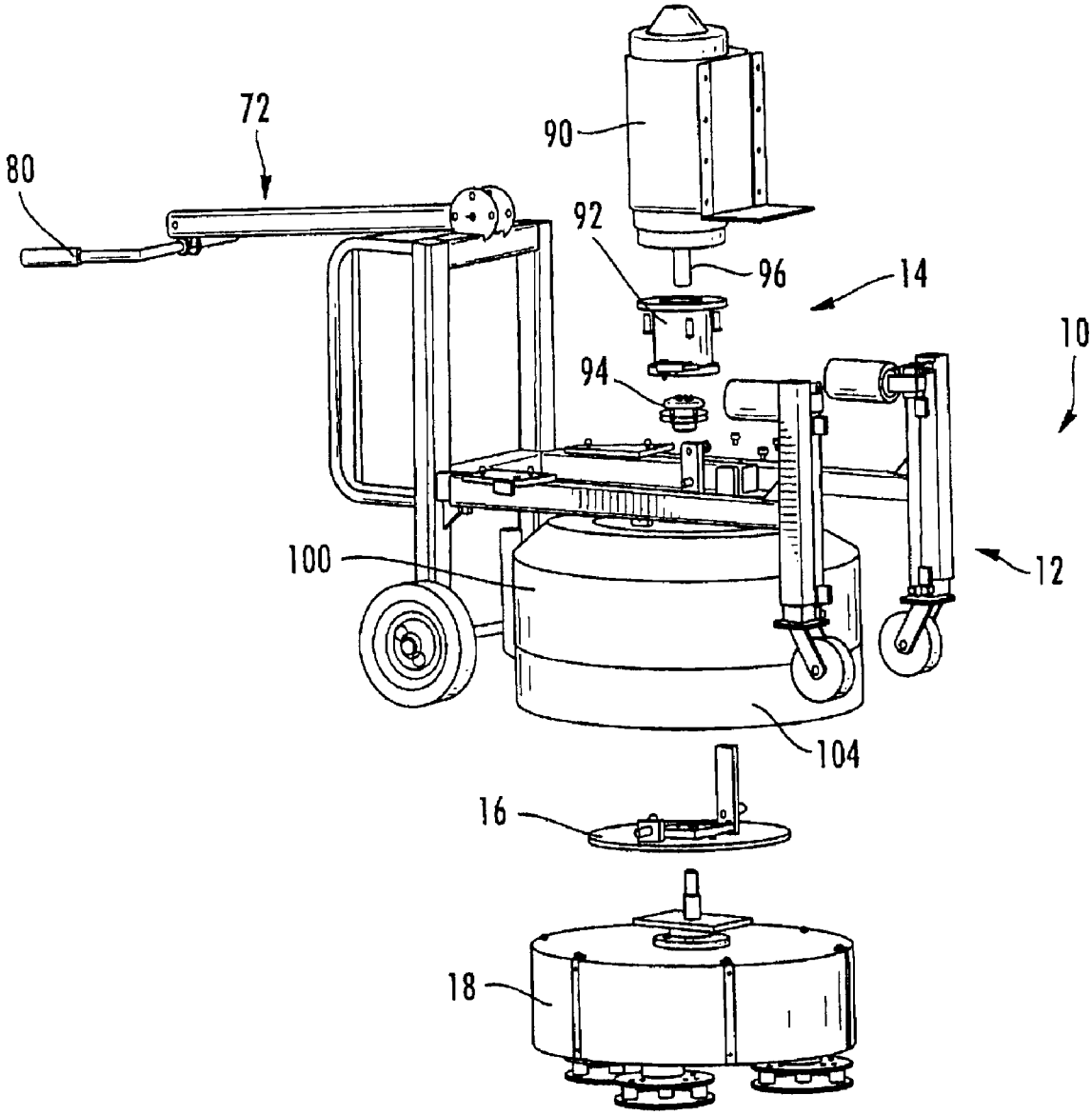
FIG. 1 is an exploded perspective view of a treatment device in accordance with a preferred embodiment.

With initial reference to FIG. 1, the invention relates to a surface treatment device 10 that is particularly suitable for surface preparation steps such as coating removal and grinding and polishing steps desired in the preparation of concrete floor surfaces. The device 10 preferably includes, as major components, a movable frame assembly 12, a drive assembly 14, a mounting assembly 16, and a drum assembly 18 that is driven by the drive assembly 14.

One feature of the disclosure relates to the structure of the drum assembly which provides counter-rotation of the drum assembly relative to the direction of rotation of the surfacing discs to provide improved handling characteristics.

Another feature relates to the inclusion of leg structures which are pivotable relative to the frame and of adjustable height. The leg structures cooperate with a pivotal mounting structure associated with the drive and drum assemblies to facilitate maintenance tasks, such as replacement of surfacing disks.

Yet another feature relates to a handle structure that can be configured in a variety of positions and adapted to assist with maintenance tasks such as motor removal.

Frame Assembly 12

Figure 2:
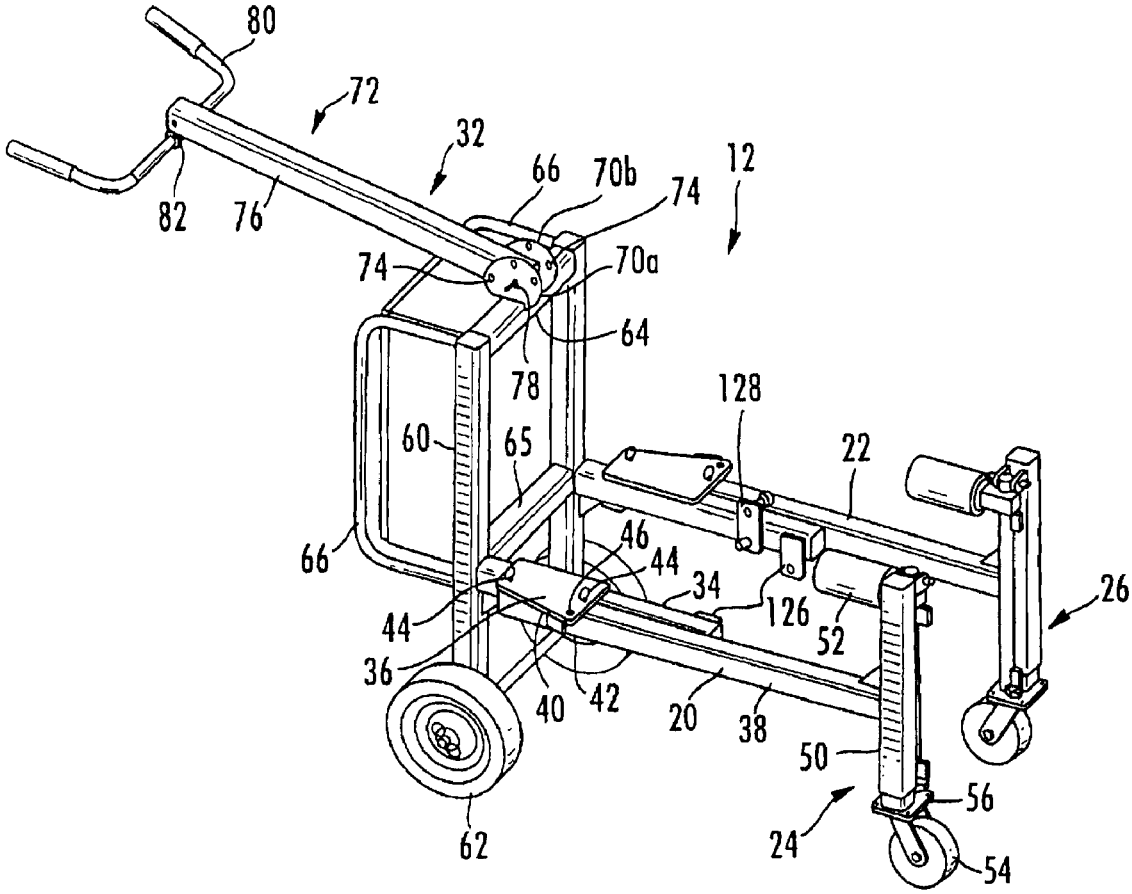
FIG. 2 is a perspective view of a frame component of the device of FIG. 1.

With reference to FIG. 2, the frame assembly 12 preferably includes a pair of horizontal support assemblies 20 and 22, a pair of front leg assemblies 24 and 26, a pair of rear leg assemblies 28 and 30, and a handle assembly 32.

The horizontal support assembly 20 preferably includes a fixed support member 34, a pivot plate 36, and a pivoting support member 38. The horizontal support assembly 22 is preferably substantially identical to the horizontal support assembly 20, except that it is configured for the opposite side.

The fixed member 34 is preferably a length of tubular steel fixed to the rear leg assembly 28, as by welding. The fixed member 34 preferably has a length sufficient to extend to approximately the middle of the drive assembly 14 (FIG. 1). As explained in more detail below, this facilitates tilting of portions of the device for maintenance and the like.

The pivot plate 36 is preferably a flat steel plate fixed, as by welding, to an upper portion of the fixed member 34, and having an edge 40 that angles away from the fixed member 34. A stop 42 preferably extends downwardly from the edge 40 and is configured for limiting pivotal movement of the pivoting support member 38. A pair of aligned fasteners 44 preferably extend through the plate 36 for attachment of the pivoting support member 38 to the plate 36.

The pivoting support member 38 is mounted to the plate 36 by the fasteners 44 so that the support member 38 is positionable adjacent to and aligned with the fixed support member 34. An aperture 46 is preferably defined through the plate 36 for passage of a pin or the like for locking the pivoting support member 38 in place. The pin may be removed from the aperture 46 to enable the pivoting support member 38 to pivot toward the stop 42. The pivoting support member 38 is preferably a length of tubular steel.

The front leg assembly 24 preferably includes a leg member 50, preferably an adjustable length leg member, an adjuster 52 for adjusting the height or length of the leg member 50, and a wheel 54 pivotally mounted at the lower end of the leg member 50 as by caster bearing 56. The front leg assembly 26 is preferably substantially identical to the front leg assembly 24, except that it is configured for the opposite side.

The leg member 50 is preferably of adjustable length, preferably being telescoping in construction and is connected, as by welding, to the forward end of the pivoting support member 38. The leg member 50 may, for example, be provided as by a pair of telescoping leg members whose relative position is controlled by the adjuster 52. The leg 50 may also be provided, for example, by a conventional jack structure having cylindrical tubular housing with a slot therein, a screw journaled within the housing, and a slidable member positioned to slide within the housing and controlled by rotation of the screw. The adjuster 52 may be powered or manual, such as an electric motor or hand crank or even alignable apertures for passage of a fastener to serve as the adjuster to select a desired length. In a preferred embodiment, the adjustable portions of the leg member 50 and the adjuster 52 are provided by an electromechanical ball drive linear actuator available under model no. 85151 from Motion Systems Corporation of Eatontown, N.J.

The rear leg assembly 28 preferably includes a leg member 60 having a wheel 62 mounted at the lower end thereof. The leg member 60 is preferably connected to the rear of the fixed member 34 as by welding. The rear leg assembly 30 is preferably substantially identical to the rear leg assembly 28, except that it is configured for the opposite side. A pair of cross members 64 and 65 preferably extend between and interconnect the rear leg assemblies 28 and 30. A pair of U-shaped members 66 may be attached, as by welding, to the rear leg assemblies 28 and 30 to enable the device to be tilted thereupon for maintenance or the like.

The handle assembly 32 preferably includes a pivot bracket 70 attached, as by welding, to the uppermost cross member 64, and a handle 72 pivotally attached to the bracket 70. The bracket 70 is preferably provided as by a pair of plates 70*a* and 70*b*. The plates 70*a* and 70*b* preferably include a plurality of aligned apertures 74 for receiving a quick release fastener to enable desired positioning of the handle 72, a described in more detail below in connection with FIGS. 8A-8B. The handle 72 is preferably provided as by an elongate member 76 pivotally connected between the plates 70*a* and 70*b* as by a fastener 78, with a grip extension 80 removably secured to the free end thereof as by a bracket or clamp 82. The grip extension 80 is preferably provided as by a U-shaped bar having rubber grips located on the ends thereof.

Drive Assembly 14

Returning to FIG. 1, the drive assembly 14 preferably includes a motor 90, preferably an electric motor, a motor mount 92, and a torque limiting coupler 94.

The motor 90 may be an electric motor, preferably having a power rating of about 15 horsepower. The motor 90 includes a rotating output or drive shaft 96 that is preferably driven at a variable rotary speed of from about 350 to about 1400 revolutions per minute (rpm).

The motor mount 92 may be provided by a motor mount available as part no. M182702C from Magnaloy Coupling Company of Alpena, Mich.

The torque limiting coupler 94 may be provided by a torque limiting coupler available as part number OSDC-3372 from Dalton Gear Company of Minneapolis, Minn.

Mounting Assembly 16

The mounting assembly 16 preferably includes a dust cover 100 and a motor base 102. The motor base 102 is pivotally mounted to the frame assembly 12, with the motor 90 being mounted to an upper surface thereof and the drum assembly 18 being mounted to the opposite lower surface thereof.

The dust cover 100 is preferably a bowl-shaped structure preferably made of sheet metal or the like that surrounds the drum assembly 18 to inhibit debris and the like generated during grinding and polishing from being thrown and for suppressing noise. A rubber sheet 104 is preferably located around the bottom perimeter of the dust cover 100. The dust cover may be attached, as by fasteners, to the bottom of the motor mount 92. Vacuum or suction lines in conjunction with a filter system are preferably provided to remove and collect dust from within the dust cover 100.

Figure 3:
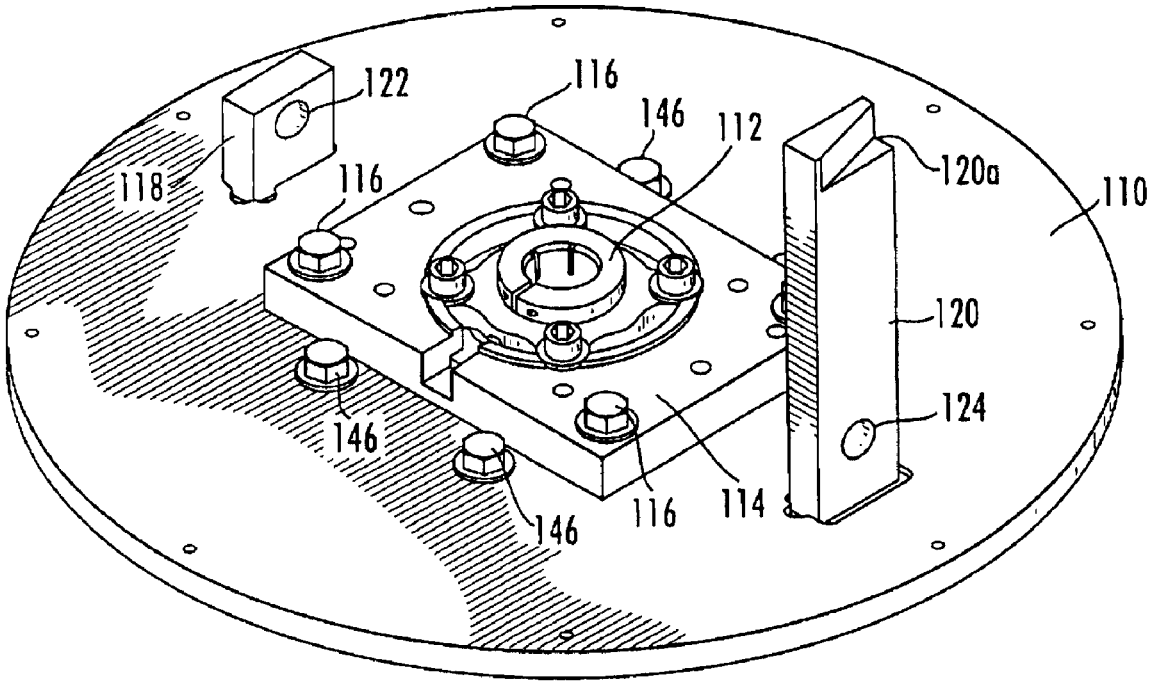
FIG. 3 is a detailed view of a motor base component of the device of FIG. 1.

With additional reference to FIG. 3, the motor base 102 preferably includes a drum pivot 110. The drum pivot 110 is preferably provided as by a circular steel plate having a central aperture for passage of the drive shaft 96 and to which is mounted a bearing 112, such as a pilot flange bearing, for receiving the shaft 96 so as to reduce frictional losses. The bearing 112 is preferably mounted to the drum pivot 110 as by an adapter ring 114 secured to the drum pivot 110 by a plurality of fasteners 116. The fasteners 116 are also preferably utilized for mounting the motor mount 92 to the motor base 102.

A pair of mounting members 118 and 120 preferably extend upwardly from the drum pivot 110. The members 118 and 120 preferably include apertures 122 and 124, respectively, to permit the drum pivot 110 to be pivotally mounted to the horizontal support assemblies 20 and 22. For example, returning to FIG. 2, a mount 126 is preferably welded to the fixed support member 34, and the corresponding fixed support member of the support assembly 22. Fasteners, such as bolts, are passed through each of the apertures 122 and 124 and corresponding apertures of the mounts 126 and secured, as by nuts threaded on the bolts, to pivotally mount the drum pivot 110 to the horizontal support assemblies 20 and 22 of the frame system 12. The mounting member 120 is preferably of extended length and includes a notched upper end 120*a* for releasably engaging and cooperating with a spring loaded latch member 128 mounted to fixed support member of the horizontal support assembly 22.

Drum Assembly 18

Figure 4:
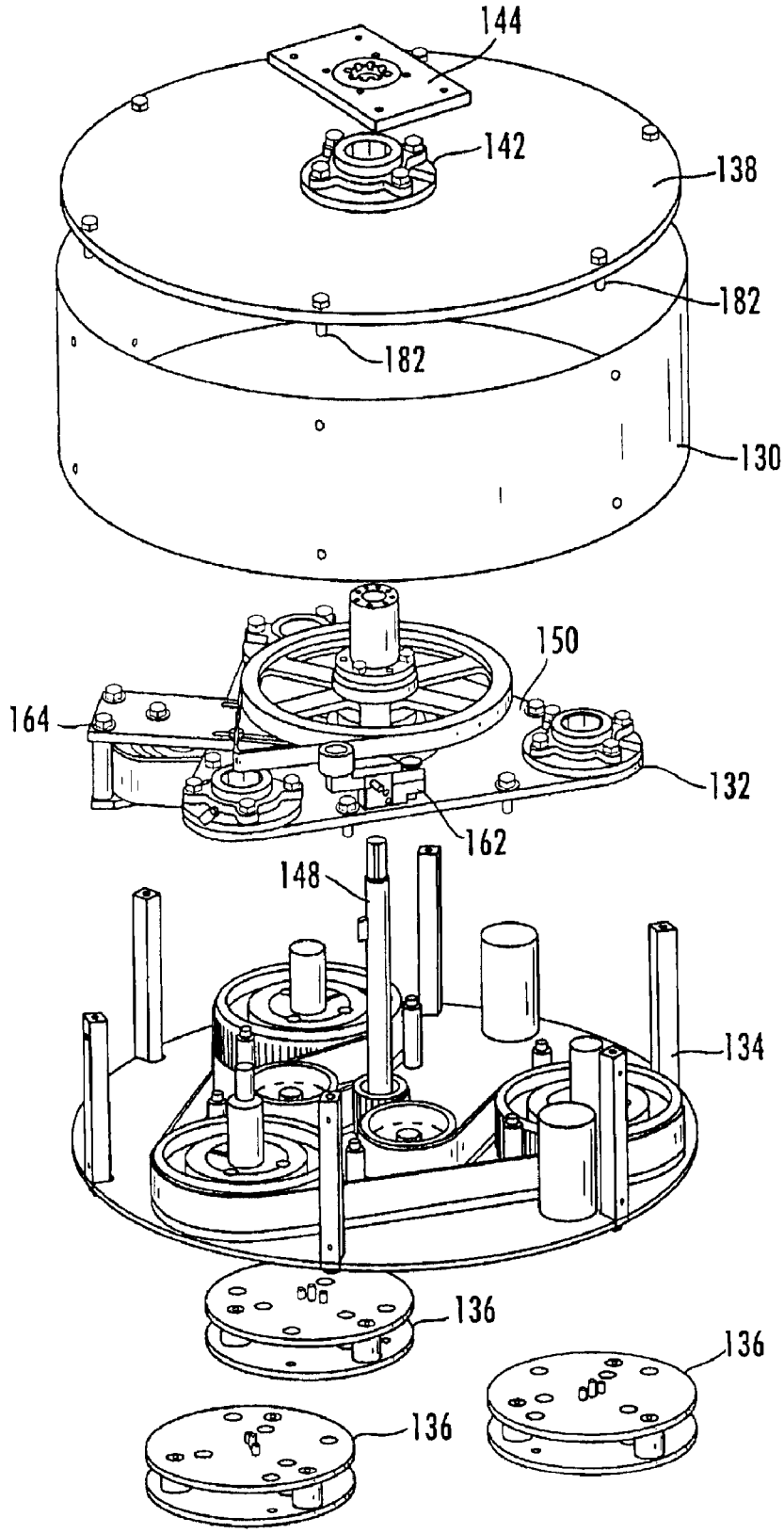
FIG. 4 is an exploded perspective view of a drum assembly of the device of FIG. 1.

With reference to FIG. 4, the drum assembly 18 preferably includes a housing 130, a middle drum assembly 132 and a lower drum assembly 134 having a plurality of abrasive surfacing discs 136.

The housing 130 preferably includes a top 138 and a sidewall 140. A bearing 142 is located on the exterior of the top 138 and a drum shaft plate 144 is provided between the bearing 142 and the motor base 102 and secured thereto as by fasteners 146 (FIG. 3). The plate 144 and the bearing 142 are configured for passage of a driven shaft 148 associated with the lower drum assembly 134 and which connects to the drive shaft 96 of the motor 90.

Figure 6:
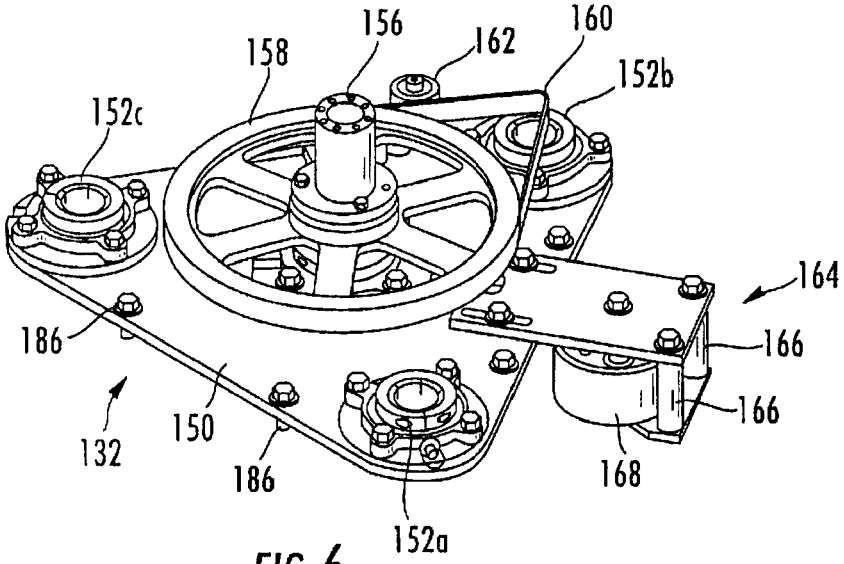
FIG. 6 is a perspective view of a middle drum assembly portion of the drum assembly of the device of FIG. 3.
Figure 5:
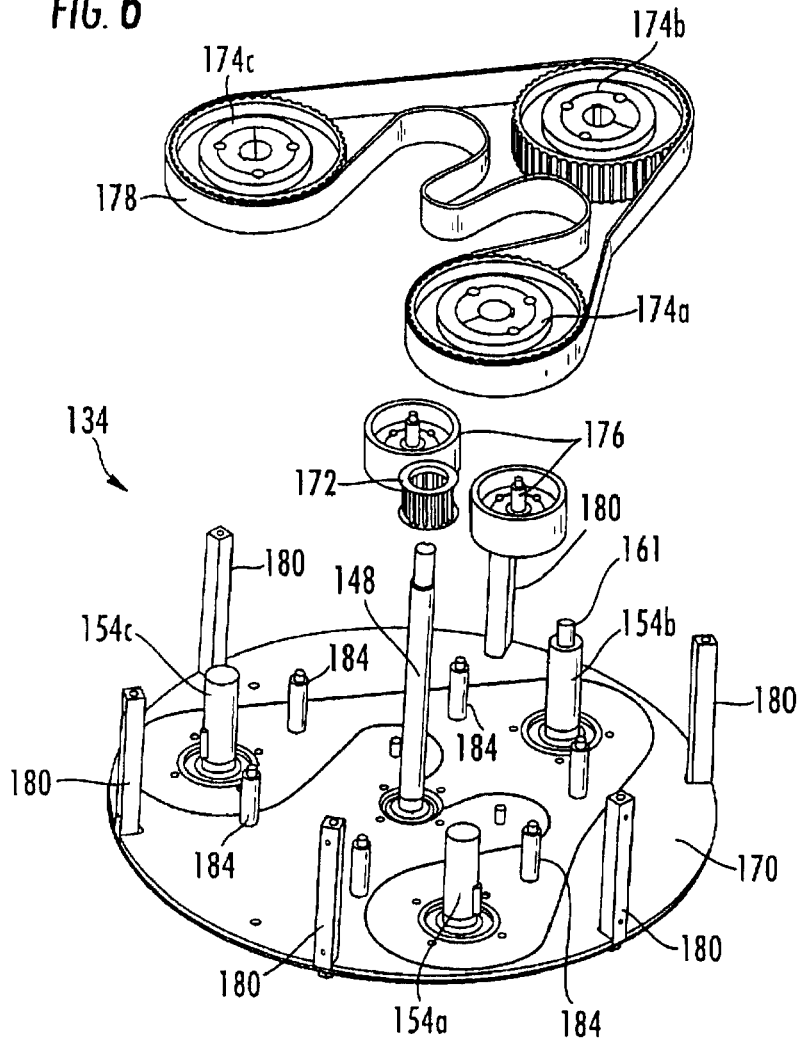
FIG. 5 is an exploded perspective view of a lower disc portion of the drum assembly of the device of FIG. 3.

With additional reference to FIG. 6, the middle drum assembly 132 preferably includes a triangular plate 150 having an aperture defined at each corner thereof and including bearings 152*a*, 152*b*, and 152*c*, such as pilot flange bearings, mounted to the plate 150 concentric with the apertures. The bearings 152*a*, 152*b*, and 152*c* are configured to receive rotatable treating shafts 154*a*, 154*b*, and 154*c* of the lower drum assembly 132. A drum shaft 156 is fixedly mounted at substantially the center of the plate 150 and fixedly supports a sheave 158. The driven shaft 148 extends through the shaft 156 of the assembled lower drum assembly. A belt 160 is located to extend around the sheave 158 and an upper end 161 of the treating shaft 154*b* which extends through the bearing 152*b*. The upper end 161 of the treating shaft 154*b* is configured for frictionally engaging the belt 160. For example, the end 161 may be of reduced diameter and have a rugous surface, be rubber coated to frictionally engage the belt 160, or include a pulley thereon. The plate 150 also preferably includes an adjustable tensioning member 162 to adjustably bear against the belt 160 to maintain it taut. A tensioning idler assembly 164 extends from the plate and is positionable in the assembled drum assembly to bear against the belt 178 of the lower drum assembly 134 described below. The assembly 164 preferably includes standoff idlers 166 and pulley 168 adjustably positionable for bearing against and tensioning the belt 178.

The lower drum assembly 134 preferably includes a lower disc 170 having the driven shaft 148 and the rotatable shafts 154*a*, 154*b*, and 154*c* each rotatably mounted thereto as by rotary bearings. The driven shaft 148 is preferably centrally located and the rotatable shafts 154*a*, 154*b*, and 154*c* are preferably arranged to in the pattern of an equilateral triangle, with the surface of the disc 170 machined for recessed mounting. The surfacing discs 136 connect to the rotatable shafts 154*a*, 154*b*, and 154*c* on the opposite or lower side of the lower disc 170 and are preferably conventional treating discs having a diameter of about 10⅝ inches.

A timing pulley 172 is located on the driven shaft 148 and timing pulleys 174*a*, 174*b*, and 174*c* are located on the rotatable shafts 154*a*, 154*b*, and 154*c*, respectively. Idler pulleys 176 are preferably provided for providing desired travel of a belt 178 positioned to runs around the belt pulleys as seen in FIGS. 3 and 4. As mentioned above, the tension of the belt 178 is adjustable as by the tensioning idler assembly 164. Standoffs 180 preferably extend upwardly around the perimeter of the lower disc 170 and receive fasteners 182 associated with the top 138 of the housing 130 (FIG. 4). Additional interior standoffs 184 are located on the lower disc 170 and receive fasteners 186 associated with the plate 150.

In operation, the driven shaft 148 is rotated by the drive shaft 96, which drives the belt 178 to turn the rotatable shafts 154*a*, 154*b*, and 154*c* (via the pulleys 174*a*-174*c*), and hence the surfacing discs 136 in a first direction. The rotation of the shaft 154*b* is transferred via the belt 160 and the sheave 158 to cause the plate 150 to rotate in a second direction opposite the first direction. The rotation of the plate 150 results in corresponding rotation of the housing 130 and the lower disc 170 in the second direction opposite to the direction of rotation of the surfacing discs 136. This counter-rotation action is advantageous to improve handling and control of the device during operation. It will be appreciated that the various pulley and sheave sizes may be selected and varied to provide different rotational characteristics.

Figure 7A:
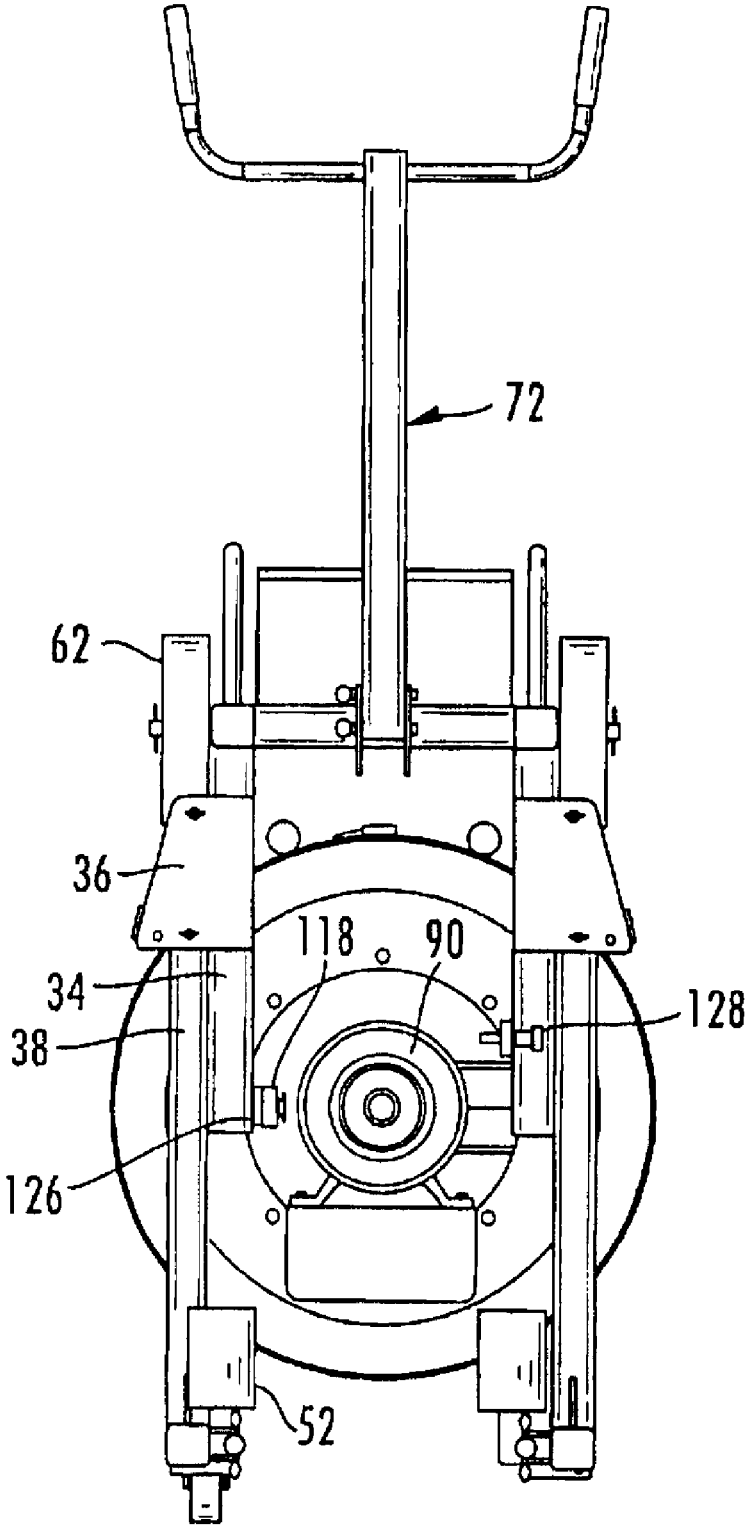
FIG. 7A is a top plan view of the device of FIG. 1, showing legs thereof in their normal operating orientation.
Figure 7B:
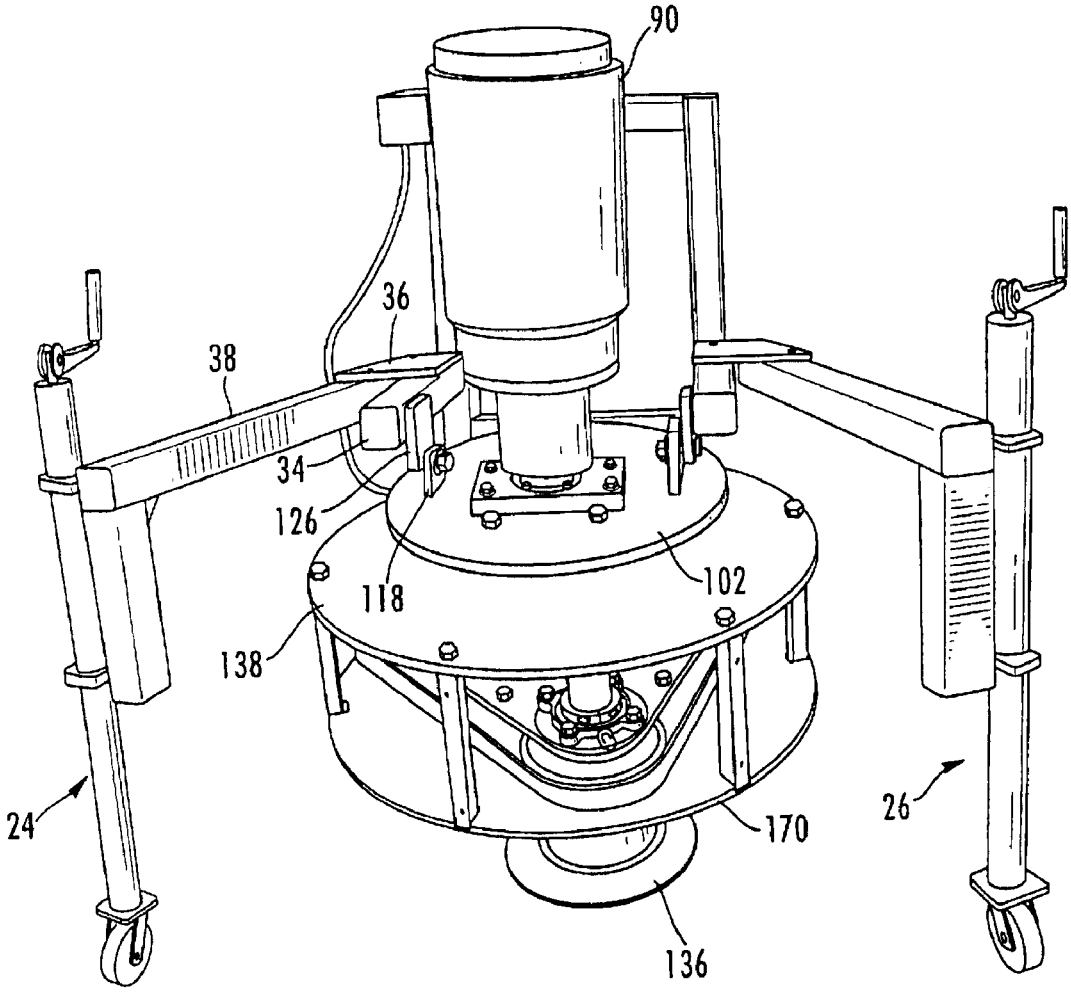
FIG. 7B is a front perspective view of the device of FIG. 1, with the legs of the frame thereof raised and spread apart for facilitating maintenance of the device.
Figure 7C:
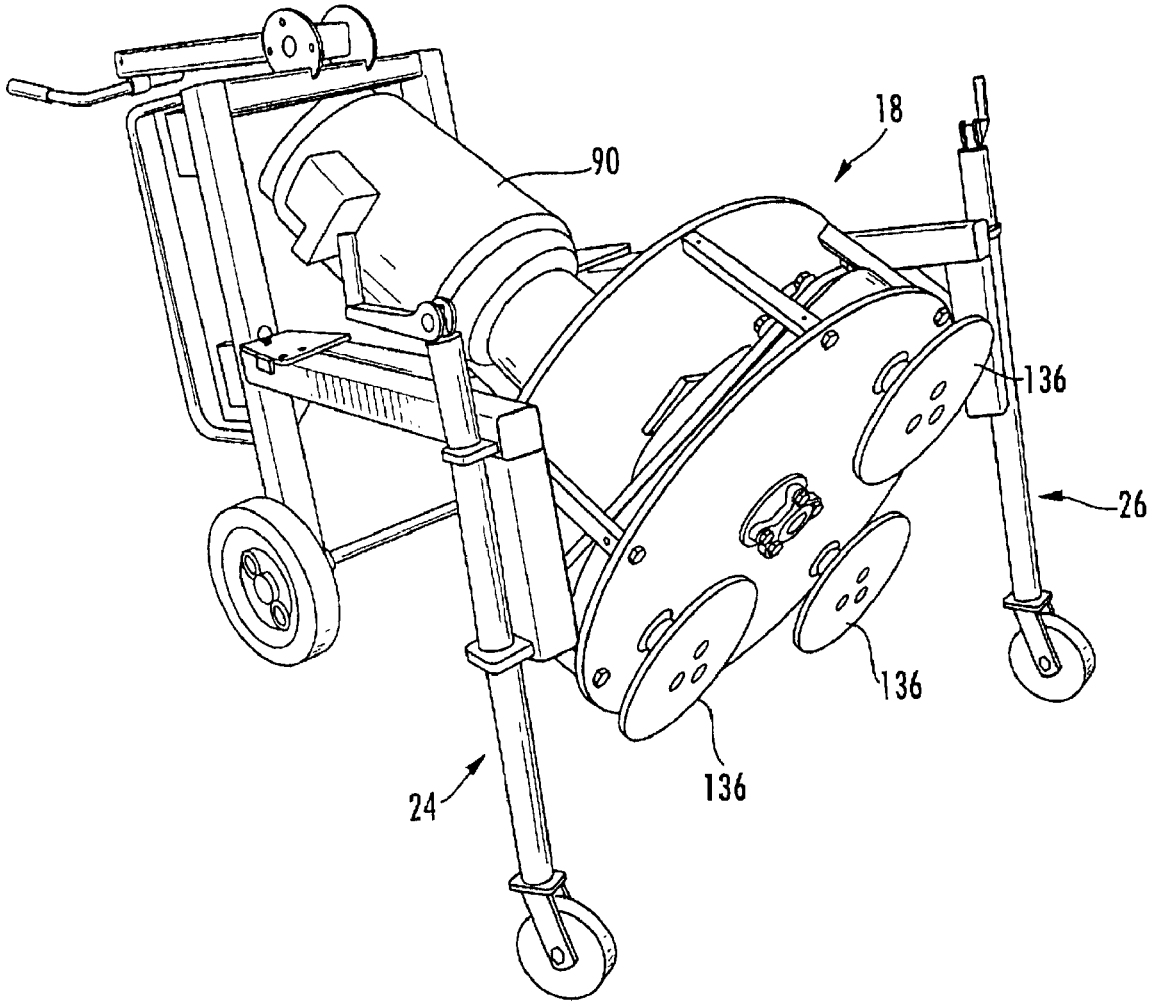
FIG. 7C shows portions of the device tilted for facilitating maintenance.

Turning now to FIGS. 7A, 7B, and 7C, the device 10 is described in connection with another feature relating to the inclusion of the front leg structures 24 and 26 which are pivotable relative to the frame and of adjustable height. The leg structures 24 and 26 cooperate with the motor base 102 which is pivotally mounted to the frame to facilitate maintenance tasks, such as replacement of surfacing disks.

In FIG. 7A, the device 10 is shown with the front leg structures 24 and 26 secured in a position appropriate for normal use of the device 10 for grinding and polishing. In this position, the pivoting support members of the leg structures 24 and 26 are parallel to and secured against the fixed support members of the frame. For example, the pivoting support member 38 is secured against the fixed support member 34 and a pin or the like is passed through the aperture 46 to lock the pivoting support member 38 in place. Also, the front leg structures 24 and 26 are adjusted in length to an unextended position so that the drum assembly 18 is in a working or level position proximate the surface to be polished, such as depicted in FIG. 8A.

In the event it is desired to perform maintenance, such as replacing the surfacing discs 136, the front leg structures 24 and 26 are preferably extended and pivoted to a spread orientation as shown in FIG. 7*b* to provide clearance for the drum assembly 18 to be titled relative to the frame 12. This may be accomplished, for example, by operating the adjuster associated with each leg structure, such as the adjuster 52 associated with the leg structure 24, to lengthen the leg members associated with the leg structures, such as the leg member 50 of the leg structure 24, an equal amount. In addition, the pivoting support members are released from their locked positions and pivoted away from the fixed support members of the leg structures. For example, the pin may be removed from the aperture 46 to enable the pivoting support member 38 to pivot away from the fixed support member 34 and toward the stop 42.

Next, as seen in FIG. 7C, the drum assembly 18 may be pivoted so that the motor 90 is angled toward the rear of the device and the surfacing disks 136 are exposed. The drum assembly 18 may be desirably maintained in this orientation as by placing the latch member 128 in engagement with the upper end 120*a* of the mounting member 120. The device may be easily returned to an operating position once the maintenance is completed.

Figure 8A:
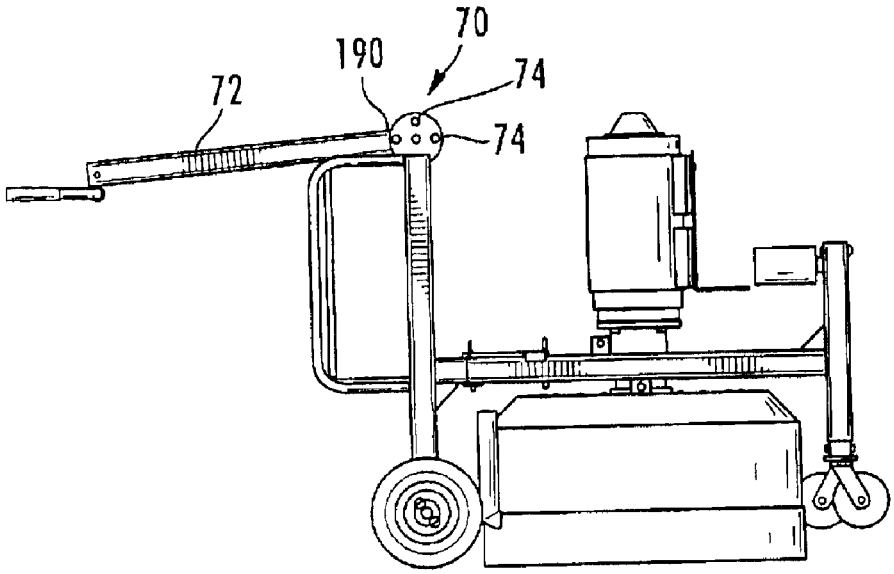
FIG. 8A is a side view of the device of FIG. 1, with the handle thereof oriented in the normal use position.
Figure 8B:
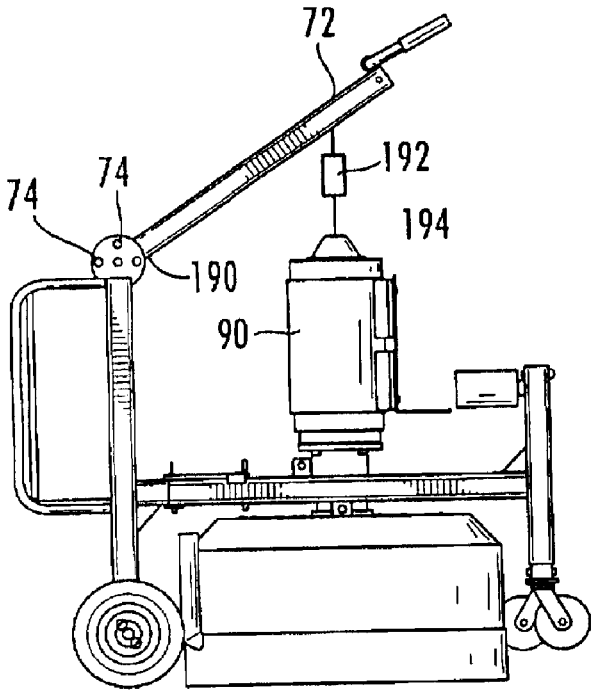
FIG. 8B shows the handle oriented to a raised position and equipped with a winch assembly useful for removing the motor.

Turning now to FIGS. 8A and 8B, the device 10 is described in connection with another feature relating to the handle system 32 that can be utilized to assist with maintenance tasks such as motor removal.

As mentioned above, the handle 72 is pivotally attached to the pivot bracket 70 and is secured in a desired position as by a quick release fastener extended through pairs of the aligned apertures 74 of the bracket 70. In this regard, FIG. 8A shows the handle 72 positioned for normal use of the device 10 to polish a floor, with a fastener 190 positioned through the appropriate apertures 74 to provide this orientation.

With reference to FIG. 8B, the position of the handle 72 has been adjusted to fixedly locate the handle to extend at an angle above the motor 90. For example, the fastener 190 was removed, the handle 72 pivoted to the shown orientation, and the fastener 190 installed in the corresponding apertures 74. In addition, a mechanical or electrical wench or so-called "come-along" device 192 has been secured to the handle 72, with a cable 194 thereof attached to the motor 90. For example, the motor 90 may include an eye-bolt or the like for attachment of the cable or a hook associated therewith. Next, the motor 90 may be unsecured from the motor mount 92 and the wench 192 operated to raise it upwardly from the mounting assembly 16 and the drum assembly 18. Also, the mounting assembly 16 may be released from the frame assembly 12, as by removal of the fasteners associated with the mounting members 118 and 120. The frame assembly 12 may then be moved away from the remaining mounting assembly 16 and drum assembly 18 for travel of the motor 90 to location for repair, such as a work bench.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. Apparatus for treating flooring surfaces, the apparatus comprising:

a motor having a rotatable drive shaft; and a drum assembly driven by the drive shaft, the drum assembly comprising:

a first assembly including a first support having a plurality of rotatable treating shafts rotatably located thereon and operably connected to the drive shaft by a first belt so that rotation of the drive shaft results in rotation of each of the treating shafts in a first direction, each of the treating shafts having a surfacing disc operatively connected to a first end thereof for rotation in the first direction for treating of a flooring surface, a second assembly including a second support fixedly connected to the first support and configured to receive a second end of a selected one of the rotatable treating shafts opposite the surfacing disc associated therewith, a sheave fixedly connected to the second support, and a second belt which extends around the sheave and the second end of the selected rotatable treating shaft, wherein during operation of the apparatus, substantially continuous rotation of the drive shaft drives the first belt which results in substantially continuous rotation of the rotatable treating shafts including the selected treating shaft, and wherein the rotation of the selected treating shaft is transferred to the sheave by the second belt so as to cause the first and second supports to substantially continuously rotate in a second direction opposite the first direction.

2. The apparatus of claim 1, wherein the first assembly includes a driven shaft connected to the drive shaft of the motor and substantially centrally located on the first support, with a pulley located on the driven shaft for engaging the first belt.

3. The apparatus of claim 1, wherein the first support comprises a disc.

4. The apparatus of claim 1, wherein the second support comprises a substantially triangular-shaped plate.

5. The apparatus of claim 1, wherein the second end of the selected one of the rotatable treating shafts includes a pulley for engaging the second belt.

6. The apparatus of claim 1, wherein the sheave is mounted on a shaft fixedly mounted on the second support.

7. The apparatus of claim 1, further comprising a movable frame onto which the drum assembly is mounted.

8. The apparatus of claim 1, further comprising a first and second tensioning assemblies mounted on the second support for contacting the first and second belts for maintaining desired tension of the first and second belts.

9. The apparatus of claim 1, further comprising standoffs located between the first and second supports for connectively maintaining the first and second supports a predetermined distance apart.

10. Apparatus for treating flooring surfaces, the apparatus comprising:

a treating assembly including a motor having a rotatable drive shaft; and a drum assembly driven by the drive shaft, the drum assembly comprising:

a first assembly including a first support having a plurality of rotatable treating shafts rotatably located thereon and operably connected to the drive shaft by a first belt so that rotation of the drive shaft results in rotation of each of the treating shafts in a first direction, each of the treating shafts having a surfacing disc operatively connected to a first end thereof for rotation in the first direction for treating of a flooring surface, a second assembly including a second support fixedly connected to the first support and configured to receive a second end of a selected one of the rotatable treating shafts opposite the surfacing disc associated therewith, a sheave fixedly connected to the second support, and a second belt which extends around the sheave and the second end of the selected rotatable treating shaft, wherein during operation of the apparatus, substantially continuous rotation of the drive shaft drives the first belt which results in substantially continuous rotation of the rotatable treating shafts including the selected treating shaft, and wherein the rotation of the selected treating shaft is transferred to the sheave by the second belt so as to cause the first and second supports to substantially continuously rotate in a second direction opposite the first direction;

a frame including a first fixed support member pivotally supporting the treating assembly, a first pivoting support member pivotally connected to the first fixed support member, and a first leg assembly connected to the first pivoting support member and having an adjustable length; and a handle movably connected to the frame between a first position and a second position, and a wench connectable to the handle, wherein the handle may be positioned in the first position for treating flooring surfaces and in the second position to substantially overlie the treating assembly, and wherein when the handle is positioned in the second position the wench may be connected to the handle at a location to enable the wench to be utilized to remove a portion of the treating assembly.

* * * * *